US005335136A

United States Patent [19]

Locher et al.

[11] Patent Number: 5,335,136

[45] Date of Patent: Aug. 2, 1994

[54] ELECTRONIC CIRCUIT ARRANGEMENT FOR TRIGGERING SOLENOID VALVES

[75] Inventors: Johannes Locher, Stuttgart; Herbert Graf, Ditzingen; Néstor Rodríguez-Amaya, Stuttgart; Alfred Schmitt, Ditzingen; Joachim Tauscher, Stuttgart; Werner Zimmermann, Gerlingen, all of Fed. Rep. of Germany

[73] Assignee: Robert Bosch GmbH, Stuttgart, Fed. Rep. of Germany

[21] Appl. No.: 74,000

[22] Filed: Jun. 9, 1993

Related U.S. Application Data

[63] Continuation of Ser. No. 720,470, filed as PCT/DE89/00785, Dec. 21, 1989, abandoned.

[30] Foreign Application Priority Data

Dec. 29, 1988 [DE] Fed. Rep. of Germany ..... 3844193

[51] Int. Cl.[5] ..... H01H 47/00

[52] U.S. Cl. ..... 361/160; 361/194; 361/210; 123/490

[58] Field of Search ..... 361/152, 153, 154, 155, 361/156, 160, 159, 194, 205, 166, 210; 123/490; 251/129.05

[56] References Cited

U.S. PATENT DOCUMENTS

| | | | |
|---|---|---|---|
| 3,340,407 | 9/1967 | Sinclair | 307/101 |
| 4,327,692 | 5/1982 | Harsch et al. | 123/490 |
| 4,377,144 | 3/1983 | Takahashi | 123/490 |
| 4,835,655 | 5/1989 | Ricci et al. | 361/159 |
| 4,862,866 | 9/1989 | Calfus | 123/490 |
| 4,922,805 | 6/1990 | Calfus | 351/152 |

FOREIGN PATENT DOCUMENTS

2452077A1 5/1976 Fed. Rep. of Germany ..... H01F 7/18

OTHER PUBLICATIONS

Patent Abstracts of Japan, vol. 7, No. 140 (E-182)(1285), dated Jun. 18, 1983.

Patent Abstracts of Japan, vol. 7, No. 182 (E-192)(1327), dated Aug. 11, 1983.

Electrotechnische Zeitschrift—Etz.—A, vol. 87, No. 4, dated 1966.

*Primary Examiner*—Jeffrey A. Gaffin

*Attorney, Agent, or Firm*—Kenyon & Kenyon

[57] ABSTRACT

The invention relates to an electronic circuit arrangement for triggering excitation windings of electromagnetic components, provided with supplementary circuit elements, in particular free-running circuit elements, preferably solenoid valves ($MV_1$ to $MV_n$), whereby in order to provide a flexible open-loop control, the components are each connected in series to a controllable contact element (3). To reduce the degree of complexity of the circuit, the manufacturing price and the space requirement, it is proposed that the connecting terminals (1, 4) of this series connection lead directly, and the connections (2) between the components ($MV_1$ to $MV_n$) and the contact elements (3) lead via diodes ($D_1$ to $D_n$), respectively, to a collecting point (A, B, C), to which collecting points (A, B, C) is linked one and the same supplementary circuit-element configuration ($T_F$,$C_L$,10,11) shared by all components. Accordingly, the component parts of the supplementary circuit elements are subject to multiple use; they are available to all of the electromagnetic components.

15 Claims, 1 Drawing Sheet

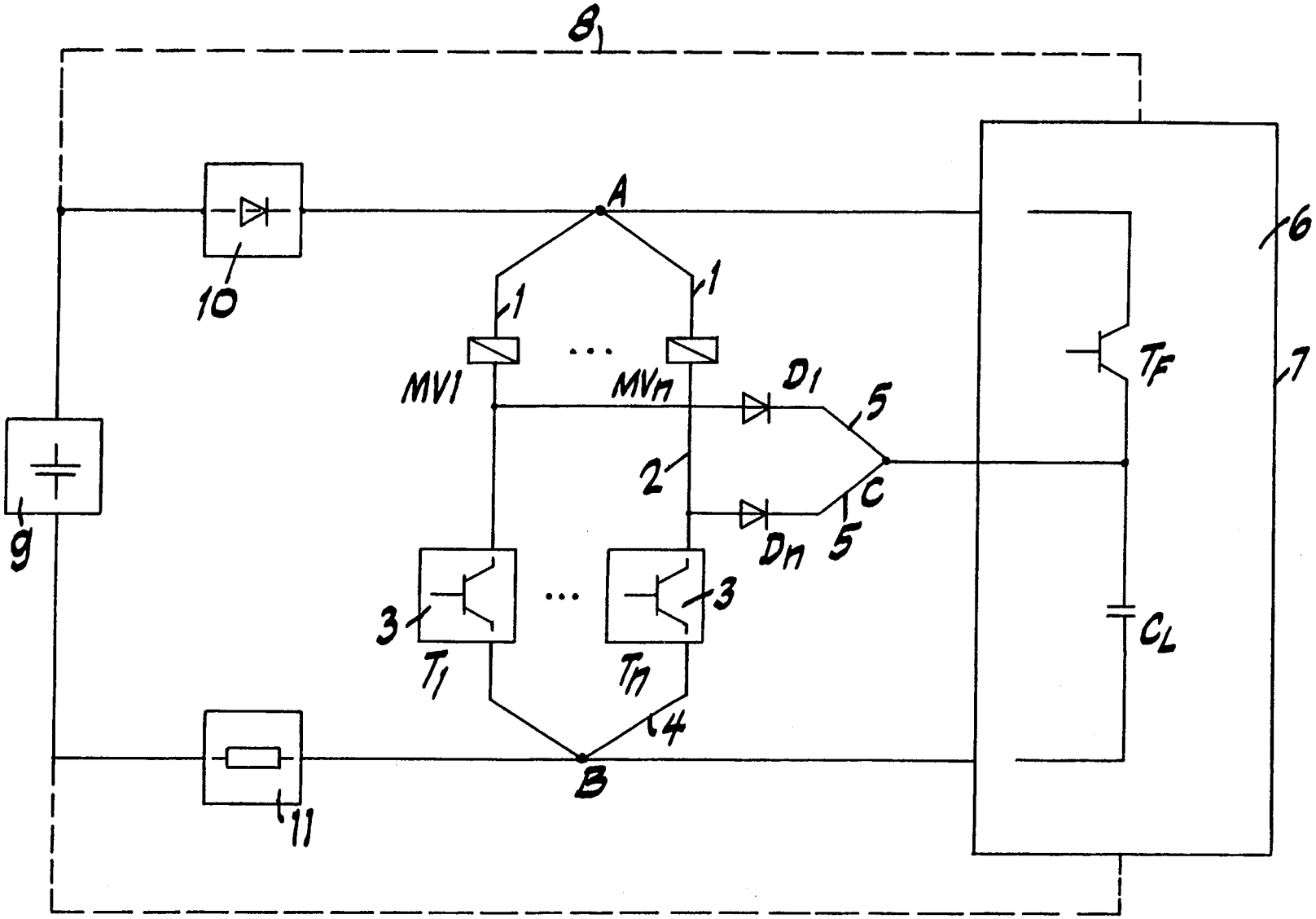
6
7
TF
CL
5
C
5
D1
Dn
1
1
MVn
MV1
2
3
3
Tn
T1
4
A
B
8
10
11
9

ELECTRONIC CIRCUIT ARRANGEMENT FOR TRIGGERING SOLENOID VALVES

This is a continuation-in-part of application Ser. No. 07/720,470 filed as PCT/DE89/00785, Dec. 21, 1989, now abandoned.

BACKGROUND OF THE INVENTION

The invention relates to an electronic circuit arrangement for triggering solenoid valves.

These types of circuit arrangements are used, for example, to trigger the excitation windings of solenoid valves, as find application in particular in the open-loop control of injection systems for combustion engines.

The known electronic circuit arrangements used in injection systems for combustion engines require a relatively complex circuitry to trigger the solenoid valves. On the one hand, this results in a relatively high manufacturing price, while on the other hand, however, the electronic components also require a suitable space.

The JP-A-5 854 611 discloses an electronic circuit arrangement of two excitation windings of an electromagnet, in the case of which the excitation windings are connected in series to a controllable contact element in the form of switching transistors. Both excitation windings of the electromagnet can be connected via a break device to a power supply device. Furthermore, a free-wheeling circuit, which comprises one series connection each of a diode and of a Zener diode, is provided for each excitation winding. From the document DE-A-2 452 077, one knows of a triggering and current-recovery circuit for the printer magnets of a high-speed printer, in the case of which a multitude of excitation windings are connected in series both by means of contact elements as well as by means of diodes to a current source. One connecting terminal each of all excitation windings is connected to a shared line, which is connected in the closed-circuit condition via a contact-break distance of a switching transistor and in the blocked condition via a diode, which is poled in the blocking direction, to a power supply device. The electromagnets are disconnected by switching over the contact elements assigned to each of the excitation windings, whereby the excitation windings are separated from the power supply unit and from a capacitor contained therein. The induction voltage induced in the excitation windings of the electromagnets is fed back into the power supply unit via the diode, which is assigned to each excitation winding and switched for this voltage in the conducting direction.

SUMMARY OF THE INVENTION

The present invention is directed to an apparatus for controlling solenoid valves in a fuel injection system for an internal combustion engine, comprising a plurality of solenoid valves and a plurality of first transistors, each of which is coupled to a respective solenoid valve. The apparatus further includes a plurality of first diodes, each having an input coupled between a respective solenoid valve and a first transistor. A second transistor is coupled to the output of each first diode through a first collecting point and to each solenoid valve through a second collecting point. A capacitor is coupled to the output of each first diode and to the second transistor through the first collecting point and to the first transistors through a third collecting point.

In one apparatus of the present invention the second transistor is a free-wheeling transistor and the capacitor is a quench capacitor. In another apparatus of the present invention, a resistor, which may be a dropping resistor, is coupled to the capacitor and to the first transistors through the third collecting point. In yet another apparatus of the present invention, a second diode, which may be a damping diode, is coupled to the solenoid valves and to the second transistor through the second collecting point.

In contrast, the advantage of the electronic circuit arrangement according to the invention is that the supplementary circuit elements for the individual solenoid valves have a multiple use. It is nevertheless possible, however, to switch the individual solenoid valves on and off independently from each other. In this manner, one reduces apparatus-related expenditure and thus also space requirements, while still providing a flexible open-loop control. The circuit design according to the invention is also particularly simple in so far as only three different collecting points are configured, to which are connected then the supplementary circuit elements shared by all the solenoid valves.

A free-wheeling contact element belonging to the supplementary circuit elements lies between the collecting point on the solenoid-valve side and the collecting point on the diode side. This free-wheeling contact element is preferably designed as a free-wheeling transistor. Therefore, this free-wheeling contact element takes over the free-running current of all solenoid valves during the disconnect operation. A quench capacitor, which belongs to the supplementary circuit elements, is situated between the collecting point on the contact-element side and the collecting point on the diode side. Here as well, the principle according to the invention explained above is followed in that namely only one quench capacitor is provided, however, it controls all the electronic components.

The degree of complexity of the circuit on the side of the operating-voltage source is able to be reduced considerably by means of the invention in that a damping diode belonging to the supplementary circuit elements is connected in series between the collecting point on the solenoid-valve side and the collecting point on the circuit-element side. Accordingly, this damping diode is the sole component part to be allocated to all the electromagnetic components.

Furthermore, in the same previously clarified manner, a dropping resistor belonging to the supplementary circuit elements can be preferably connected in series to the operating-voltage source and, accordingly, is likewise subjected to a multiple use.

BRIEF DESCRIPTION OF THE DRAWING

The invention shall be clarified in greater detail in the following based on the drawing.

In a schematically simplified representation, the Figure shows a circuit diagram of the electronic circuit arrangement.

DETAILED DESCRIPTION

According to the Figure, the electronic circuit arrangement shows a multitude of solenoid valves $MV_1$ to $MV_n$, which represent electromagnetic components provided with excitation windings. The multitude of solenoid valves $MV_1$ to $MV_n$ is characterized in the Figure by the row of dots. The leads of the single excitation windings of the solenoid valves $MV_1$ to $MV_n$ are connected via lines 1 to a collecting point A. The ends of the excitation windings of the solenoid valves $MV_1$ to $MV_n$ lead via lines 2 to controllable contact elements 3, which are designed as bipolar transistors $T_1$ to $T_n$. Accordingly, a bipolar transistor $T_1$ to $T_n$ is assigned respectively to each solenoid valve $MV_1$ to $MV_n$. The individual lines 2 lead via the respective collector-emitter section of the transistors $T_1$ to $T_n$ and via lines 4 to a further collecting point B.

Each line 2 leads to a diode $D_1$ to $D_n$ and, from there, via lines 5 to a third collecting point C. Components of supplementary circuit elements are linked to the individual collection points A, B and C in a way that enables these components to interact with all of the solenoid valves $MV_1$ to $MV_n$. Accordingly, the individual, supplementary circuit-element components have a multiple use.

In detail, the procedure is such that a free-wheeling contact element 6, which belongs to the supplementary circuit elements and is designed as a free-wheeling transistor $T_F$, is situated between the collecting point A on the component side and the collecting point C on the diode side.

Moreover, a quench capacitor $C_L$ is operated between the collecting point B on the contact-element side and the collecting point C on the diode side. The concrete circuit configuration of the free-wheeling transistor $T_F$ and the quench capacitor $C_L$ is not represented in detail in the Figure; it is only hinted at by the depiction of the printed circuit board 7 which accommodates these component parts. Its supply voltage is received by the circuit of the printed circuit board 7 via lines 8, drawn by dotted lines, which lead to an operating-voltage source 9.

The positive pole of the operating-voltage source 9 leads to a damping diode 10, its other connecting terminal to the collecting point A. The negative pole of the operating-voltage source 9 is connected to a dropping resistor 11, whose other connecting terminal leads to the collecting point B.

The procedure in detail with regard to the conducting direction of the individual diodes is such that the anodes of the diodes $D_1$ to $D_n$ are connected to the lines 2, and their cathodes to the collecting point C. The anode of the damping diode 10 is connected to the positive pole of the operating-voltage source 9, while the cathode leads to the collecting point A.

The circuit arrangement works in the following way:

By triggering the individual bases of the bipolar transistors $T_1$ to $T_n$, it is possible to bring the individual solenoid valves $MV_1$ to $MV_n$ into circuit in the constellation required at any one time. This results in a flexible, open-loop control of the combustion engine's injection system, which features the solenoid valves $MV_1$ to $MV_n$. In a corresponding way, it is possible to disconnect the solenoid valves $MV_1$ to $MV_n$, whereby a free-running current can flow off via the diodes $D_1$ to $D_n$ and the free-wheeling transistor $T_F$. Although, according to the invention, only one free-wheeling transistor $T_F$ is provided for the multitude of solenoid valves $MV_1$ to $MV_n$, by properly triggering its base, there can nevertheless be a reaction to each individual switching operation of the bipolar transistors $T_1$ to $T_n$.

Furthermore, the depicted circuit arrangement makes it clear that by looping in the quench capacitor $C_L$ between the collecting points B and C, an appropriate extinction can be undertaken during the possible breaking operation of the individual solenoid valves $MV_1$ to $MV_n$, independently from each other. Here as well, in spite of the multitude of solenoid valves $MV_1$ to $MV_n$, only one quench component part is required.

Furthermore, both the damping diode 10 as well as the dropping resistor 11 are used jointly for the multitude of solenoid valves $MV_1$ to $MV_n$, resulting in optimum conditions with respect to the application of component parts, whereby nevertheless individual circuit elements can be controlled independently of other circuit elements.

We claim:

1. An apparatus for controlling solenoid valves in a fuel injection system for an internal combustion engine, comprising:

a plurality of solenoid valves;

a plurality of first transistors, each coupled in series to a respective solenoid valve;

a plurality of first diodes, each having an input coupled between a respective solenoid valve and a first transistor;

a second transistor coupled to the output of each first diode through a first collecting point and directly mechanically connected to each solenoid valve through a second collecting point; and a capacitor coupled to the output of each first diode and to the second transistor through the first collecting point and coupled to each of the first transistors through a third collecting point.

2. An apparatus according to claim 1 wherein the second transistor is a free-wheeling transistor.

3. An apparatus according to claim 1 wherein the capacitor is a quench capacitor.

4. An apparatus according to claim 1 further comprising a resistor coupled to the capacitor and to the first transistors through the third collecting point.

5. An apparatus according to claim 4 wherein the resistor is a dropping resistor.

6. An apparatus according to claim 1 further comprising a damping diode coupled to each solenoid valve and to the second transistor through the second collecting point.

7. An apparatus for controlling solenoid valves in a fuel injection system for an internal combustion engine, comprising:

a plurality of solenoid valves;

a plurality of first transistors, each coupled in series to a respective solenoid valve;

a plurality of first diodes, each being coupled on its input between a respective solenoid valve and a first transistor;

a transistor coupled to the output of each first diode through a first collecting point and directly connected to each solenoid valve through a second collecting point and through a conducting element having no active components;

a quench capacitor coupled to the output of each first diode and to the second transistor through the first collecting point and coupled to each of the first transistors through a third collecting point;

a second diode coupled to the solenoid valves and to the second transistor through the second collecting point; and a resistor coupled to the capacitor and to the first transistors through the third collecting point.

8. An apparatus according to claim 7 wherein the second diode is a damping diode and the transistor is a free-wheeling transistor.

9. An apparatus according to claim 7 wherein the resistor is a dropping resistor.

10. An apparatus for controlling solenoid valves in a fuel injection system for an internal combustion engine comprising:

a plurality of solenoid valves;

a plurality of first transistors, each coupled in series to a respective solenoid valve;

a plurality of first diodes, each being coupled by its input between a respective solenoid valve and a first transistor;

a supplementary circuit coupled to the solenoid valves, first transistors and first diodes, including a second transistor coupled to the output of each of the first diodes through a first collecting point and coupled to each of the solenoid valves through a second collecting point;

a capacitor coupled to the second transistor and to each of the first diodes and coupled to each of the first transistors; and a second diode coupled to each of the solenoid valves and to the second transistor through the second collecting point, the second diode coupling the second transistor to a voltage source.

11. An apparatus according to claim 10 wherein the supplementary circuit further includes a resistor coupled to the capacitor and to the first transistors.

12. An apparatus according to claim 11 wherein the resistor is a dropping resistor.

13. An apparatus according to claim 10 wherein the second diode is a damping diode.

14. An apparatus according to claim 10 wherein the second transistor is a free-wheeling transistor.

15. An apparatus according to claim 10 wherein the capacitor is a quench capacitor.

* * * * *